US006851633B2

(12) United States Patent
Stepaniak et al.

(10) Patent No.: US 6,851,633 B2
(45) Date of Patent: Feb. 8, 2005

(54) AUTO-TRACKING DISPENSER

(75) Inventors: Jude A. Stepaniak, Cincinnati, OH (US); Dennis E. Riehle, Cincinnati, OH (US); Randolph S. Parks, Hamilton, OH (US)

(73) Assignee: Valco Cincinnati, Inc., Cincinnati, OH (US)

( * ) Notice: Subject to any disclaimer, the term of this patent is extended or adjusted under 35 U.S.C. 154(b) by 4 days.

(21) Appl. No.: 10/310,747

(22) Filed: Dec. 5, 2002

(65) Prior Publication Data

US 2004/0108396 A1 Jun. 10, 2004

(51) Int. Cl.[7] ..... B05B 1/04; B05B 15/08; B31B 1/62; B31B 11/60; B31B 17/60

(52) U.S. Cl. ..... 239/592; 239/587.1; 239/554; 493/128; 493/150; 222/612

(58) Field of Search ..... 239/533.14, 554, 239/555, 601, 587.1, 592; 229/124; 493/52, 128, 150; 222/612, 181.2, 181.3; 137/561 A, 561 R

(56) References Cited

U.S. PATENT DOCUMENTS

| | | | | | |
|---|---|---|---|---|---|
| 1,983,323 | A | * | 12/1934 | Stokes | 493/55 |
| 2,210,846 | A | * | 8/1940 | Aghnides | 239/428.5 |
| 3,001,544 | A | * | 9/1961 | Fergason | 137/262 |
| 4,006,704 | A | | 2/1977 | Perondi | |
| 4,156,398 | A | | 5/1979 | McDaniel | |
| 4,262,582 | A | * | 4/1981 | Sugimoto et al. | 493/25 |
| 4,551,124 | A | * | 11/1985 | Mowry | 493/128 |
| 5,107,656 | A | * | 4/1992 | Katz et al. | 53/131.4 |
| 6,012,503 | A | * | 1/2000 | Balder | 156/578 |
| 6,162,157 | A | * | 12/2000 | Morisod | 493/180 |
| 6,180,952 | B1 | * | 1/2001 | Haas et al. | 250/492.2 |
| 6,234,358 | B1 | | 5/2001 | Romine et al. | |
| 6,419,750 | B1 | | 7/2002 | Tabak et al. | |
| 6,488,221 | B1 | * | 12/2002 | McDonald | 239/596 |

* cited by examiner

*Primary Examiner*—William C. Doerrler
(74) *Attorney, Agent, or Firm*—Dinsmore & Shohl LLP

(57) ABSTRACT

A liquid dispenser. The dispenser includes a base structure, a plurality of cartridges releasably mounted to the base structure, and a valve fluidly coupled with an applicator head to allow continued contact with and selective deposition of the liquid to a product passing through a travel path between the cartridges. At least one of the cartridges is linked to the base structure through a variable coupling that is linearly responsive to changes in thickness or planarity of the product such that the applicator head automatically maintains constant contact with the product, regardless of such changes, without having to stop the dispenser or ancillary pieces of machinery. The cartridges are hand interchangeable such that liquid can be deposited on either an upper or lower surface of the product without requiring any tools to affect top-down or bottom-up deposition. The applicator head is additionally hand removable from the valve such that it can be attached to or removed from the valve without requiring the use of any tools.

43 Claims, 10 Drawing Sheets

AUTO-TRACKING DISPENSER

BACKGROUND OF THE INVENTION

This invention relates to a dispenser used in liquid deposition devices, and more particularly to a high speed, high precision glue dispenser that is responsive to sheets of material passing through it such that adhesive can be deposited onto sheets of varying thickness passing through the glue dispenser without manual intervention or loss of contact between the sheets and the dispenser, even if the sheets demonstrate non-planar attributes.

Automated gluing systems are routinely used to affect high-speed, repeatable application of adhesives to various substrates. This practice has been used extensively in the manufacture of paper and related products, such as corrugated cardboard, where devices known as flexo folder gluers receive one or more sheets to have them printed, die cut, glued and folded. While in the gluing station portion of the flexo folder gluer, the sheet has one or more rows of continuous adhesive lines or discontinuous adhesive dots deposited onto one or more of its flap surfaces as it travels past a glue applicator head. In a conventional gluing station, the sheet is fed into a gap along a preferred path such that an aligned valve and nozzle can be actuated to deposit a stream of the adhesive onto the desired location on the sheet. The one or more valves are securely mounted to a support structure, such as a mounting plate to ensure consistent adhesive application. While this works well for its intended purpose, it tends to be inflexible in terms of changing the valves out when service is required. In addition, by rigidly fixing the gap spacing, the system is not well-suited to accommodating sheets that demonstrate non-planar attributes (such as curled, warped or related surface undulations), or sheets of differing thickness, as thin sheets tend to float or bounce around, while thick substrates tend to pinch, causing substrate misalignment and subsequent compromise of adhesive deposition.

One way to avoid the inaccuracies and down-time of a fixed applicator is to incorporate a "floating" dispenser, where the dispensing member is movable relative to the rest of the applicator due to the use of a slide bearing. While these help reduce the incidence of pinching and subsequent jamming of sheets as they pass by the dispenser, the repeated, intermittent periods of non-contact between the head and the sheets being glued does not adequately allow the system to purge any residual glue from the discharge apertures located on the applicator head. This makes the head prone to the buildup of dried, hardened glue around its discharge apertures, which leads to a concomitant decrease in glue deposition quality.

What is needed is a glue dispenser that can adjust automatically to travelling sheets with surface undulations or of differing thickness without requiring the user to adjust the mechanism or otherwise interrupt operation of the machine. What is additionally needed is a way to keep the passing sheet in constant contact with the applicator head during glue deposition without too tight of a fit to promote accurate, repeatable glue application to sheets of differing thickness.

SUMMARY OF THE INVENTION

This need is met by the present invention, wherein an applicator head and valve are movably coupled to a mounting plate such that the applicator head is always in contact with a sheet, thereby improving the deposition of a liquid thereon. The sheets are not limited to corrugated cardboard, but rather can be any foldable substrate that is held together upon folding by adhesives. Similarly, the liquid deposited need not be glue or related adhesive, but can be any liquid where precise, repeatable application on a generally planar substrate is needed. According to a first aspect of the invention, an applicator head for a liquid dispenser is disclosed. The applicator head comprises an inlet configured to be coupled to a liquid source, an outlet in fluid communication with the inlet, and a shim. The outlet includes a plurality of apertures such that liquid flowing through the outlet exits through the apertures. The shim comprises a proximal end fluidly coupled to the inlet, a distal end fluidly coupled to the outlet, and a flowpath from the proximal end to the distal end, where a substantial portion of the flowpath is divergently-shaped.

Optionally, the applicator head has a quick-release mechanism disposed on the inlet. Preferably, this quick-release mechanism enables tool-free insertion and removal of the application head to a liquid source. The apertures may be linearly arranged across a dispensing surface of the outlet, while the dispensing surface can include a flow channel disposed about each of the apertures such that a flow channel extends from each aperture to a trailing edge of the dispensing surface. The applicator head further comprises a plurality of bevelled surfaces adjacent to and tapering away from the plateaued dispensing surface. Preferably, these bevelled surfaces define a faceted outer profile of the applicator head so that its resistance to causing passing sheets to pinch or jam is increased. At least two of the bevelled surfaces are preferably disposed along a lateral side of the applicator head to maximize the number of apertures used for liquid dispensing while maintaining a small contact area. The shim can be interchangeably disposed between the inlet and the outlet such that the proximal and distal ends, as well as the flowpath in between, define a manifold.

According to another aspect of the invention, a liquid dispenser is disclosed. The liquid dispenser includes a first cartridge and a second cartridge spaced relative to the first cartridge. The first cartridge includes a first mount, a first inlet guide, a valve coupled to the first mount, and an applicator head fluidly coupled to the valve. The valve is configured to be coupled to a liquid source and an actuation source. The applicator head includes a liquid inlet, a liquid outlet in fluid communication with the liquid inlet, and a shim. The liquid outlet includes a plurality of apertures for dispensing the liquid. The shim is made up of a proximal end fluidly coupled to the liquid inlet, a distal end fluidly coupled to the liquid outlet, and a flowpath, all in a manner similar to that of the previously-discussed aspect. The second cartridge includes a second mount with a second inlet guide disposed relative to the first inlet guide such that a product travel path is defined therebetween, and an outlet guide coupled to the second mount.

Optionally, the product travel path converges along the direction of product travel such that the product is guided into contact with a plateaued dispensing surface defined on the liquid outlet. In addition, the converging product travel path is made up of the first and second inlet guides configured as a pair of converging ramps. The first and second cartridges are preferably disposed vertically one above the other, although such placement is not critical. Moreover, the cartridges are interchangeable with one another, while the applicator head is configured to be quick releasable from the valve without the use of any tools. The outlet guide can be a bearing roller, which is slidably adjustable along the direction of product flow. Preferably, the valve is pneumatically or electrically actuated. A liquid deflector shield can be attached to various locations as needed, such as to the second mount, to protect select componentry from the liquid.

According to yet another aspect of the present invention, a liquid dispenser is disclosed. The liquid dispenser includes a base structure, a first cartridge releasably coupled to the base structure, a second cartridge releasably coupled to the base structure, and a variable coupling that links at least one of the cartridges to the base structure. The coupling is forcibly biased to define a first gap between an applicator head and an outlet guide on the second cartridge. The coupling moves in response to a force against at least one of the outlet guide and the applicator head, and in so doing defines a second gap that is greater than the first gap. The first cartridge includes a first mount, a valve coupled to the first mount and an applicator head fluidly coupled to the valve. The valve is configured to be coupled to a liquid source and an actuation source, while the applicator head is configured to deposit liquid onto a product while remaining in constant contact with the product. The second cartridge includes a second mount with an outlet guide coupled to the second mount. The first and second mounts on the respective first and second cartridges make up the structural backbone of the cartridges.

Optionally, the first mount includes a first inlet guide, while the second mount includes a second inlet guide. The second inlet guide is disposed relative to the first inlet guide such that a product travel path is defined between them. In addition, the bias is affected by a spring mounted between the base structure and the coupling. The applicator head may be configured as previously discussed, including the quick-release and flowpath features. In addition, at least one of the cartridges includes a quick-release mechanism to facilitate easy, tool-less removal and installation of the cartridge. Preferably, the two cartridges are arranged in a substantially vertical relationship with one another, and the coupling is preferably linked to the vertically uppermost of the first and second cartridges. Each of the cartridge first and second mounts may further include a connecting pin configured to permit quick release from the base structure. The connecting pin on each of the mounts is similar, thus facilitating cartridge interchangeability. In addition, since the cartridges are interchangeable, either can be linked to the coupling. Preferably, the first and second cartridges are substantially vertically spaced relative to one another. The coupling may additionally include a cartridge weight compensator configured to at least partially compensate for a vertically downward force component of the weight of the uppermost cartridge. This cartridge weight compensator may be in the form of a fluid-actuated piston, which may more particularly be pneumatically-actuated. In addition, the cartridge weight compensator may apply a variable (including user-defined) force to the coupling. The cartridge weight compensator may also be mounted to the base structure. The liquid dispenser may further include a linear bearing to limit the motion of the coupling along a single axis, such as a substantially vertical axis. This linear bearing may be mounted to either the base structure or the coupling such that it slidably connects the two together. Preferably, the linear bearing has a housing around it to prevent the liquid from contacting the linear bearing. In addition, the direction of movement imparted on the coupling by the cartridge weight compensator is parallel to the direction of movement in the linear bearing.

According to still another aspect of the invention, a glue dispenser is disclosed. The glue dispenser includes a base structure, a first cartridge releasably coupled to the base structure, a second cartridge releasably coupled to the base structure, and a variable coupling that links the base structure and at least one of the cartridges. The coupling is movably responsive to the passage of the product such that variations in the thickness or planarity of the product cause the variable coupling and the cartridge to which it is linked to move a proportionate distance while at least one of the outlet guide and the applicator head remain in contact with the product.

According to yet another aspect of the invention, a flexo folder gluer for manufacturing containers is disclosed. The flexo folder gluer includes at least a printing station, a die cutting station coupled to the printing station, a gluing station coupled to the die cutting station, a folding station coupled to the gluing station, and a conveying mechanism configured to transport one or more sheets between the printing, die cutting, gluing and folding stations. The glue station is similar to that described in the previous aspect of the invention.

According to another aspect of the invention, a method of depositing liquid on a sheet of material is disclosed. The method includes the steps of configuring a liquid dispenser to include a base structure, a first cartridge releasably coupled to the base structure, a second cartridge releasably coupled to the base structure and spaced relative to the first cartridge, and a coupling onto which at least one of the cartridges is mounted. The coupling is linked to the base structure and is biased to define a first gap between an applicator head and an outlet guide, and movable in response to a force against at least one of the outlet guide and the applicator head to a second gap that is greater than the first gap. Additional steps include inserting the sheet of material into the travel path, establishing contact between the applicator head and the sheet of material, and depositing liquid on at least a portion of the sheet of material while the applicator head remains in contact with the sheet of material. The first cartridge includes a first mount, a valve coupled to the first mount, a liquid source and an actuation source, and an applicator head fluidly coupled to the valve. The second cartridge includes a second mount and an outlet guide coupled to the second mount. Optionally, the method comprises the additional step of configuring the applicator head to comprise a liquid inlet, a liquid outlet and a shim as discussed previously. In addition, the sheet of material is a sheet of corrugated cardboard. Moreover, the cartridges can be configured to include respective inlet guides disposed relative to one another such that a travel path for the sheet of material is defined between the inlet guides.

BRIEF DESCRIPTION OF THE SEVERAL VIEWS OF THE DRAWINGS

The following detailed description of the present invention can be best understood when read in conjunction with the following drawings, where like structure is indicated with like reference numerals and in which.

DETAILED DESCRIPTION

Figure 1:
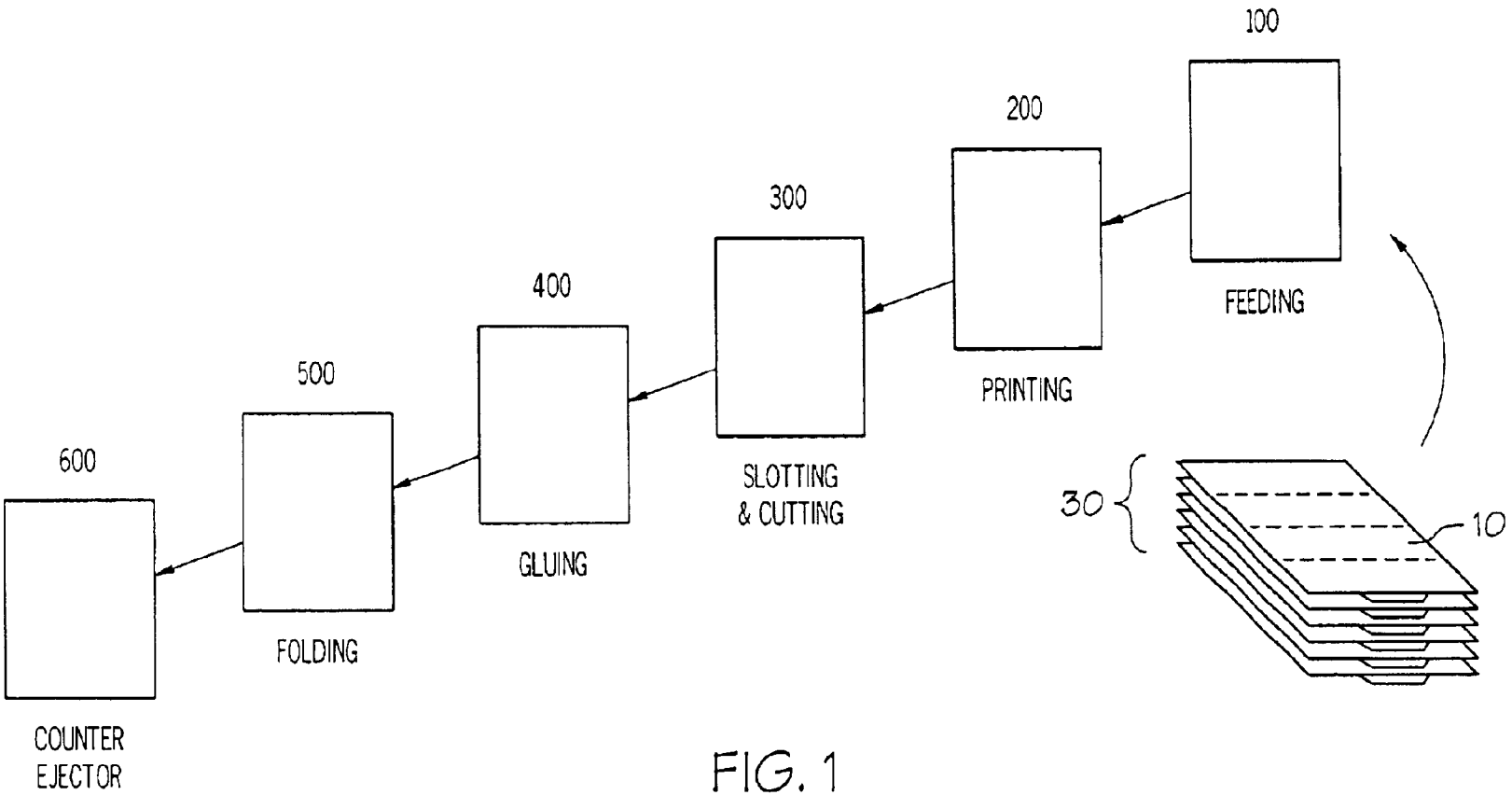
FIG. 1 shows a block diagram of a flexo folder gluer for printing, cutting, gluing and folding corrugated cardboard, including a gluing station according to the present invention and a stack of flat corrugated sheets prior to passage through the machine.
Figure 2:
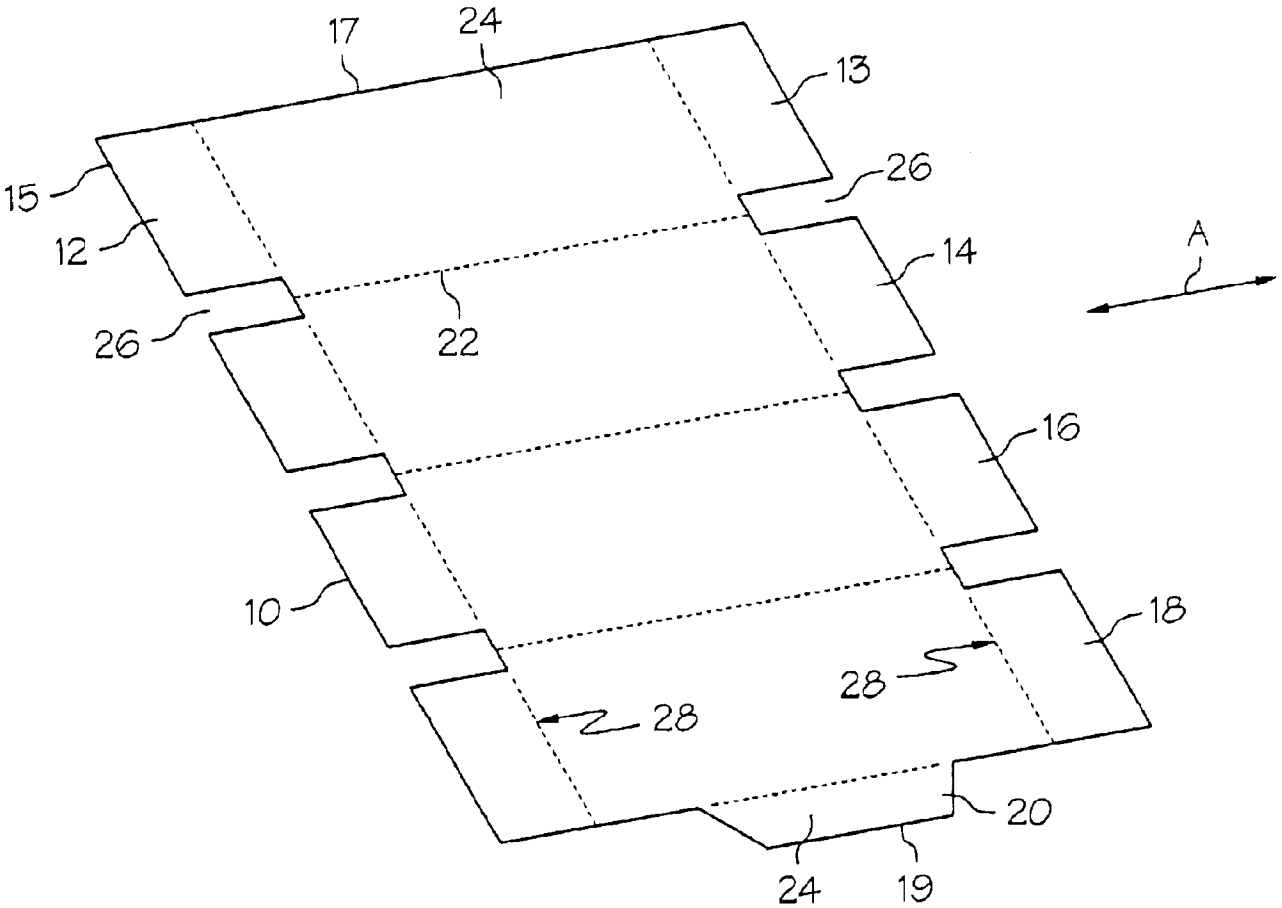
FIG. 2 shows a single sheet of the corrugated cardboard of FIG. 1, highlighting the panel and tab locations where glue is often applied.

Referring initially to FIGS. 1 and 2, a block diagram highlights the major components of a flexo folder gluer 1 according to the present invention, as well as a typical sheet 10 of corrugated paper on which the flexo folder gluer 1 operates. The flexo folder gluer 1 includes a feeding station 100, printing station 200, die cutting station 300, gluing station 400, folding station 500 and counter ejector station 600. It will be appreciated by those skilled in the art that additional components typically associated with flexo folder gluers, such as controllers, conveyors (or similar sheet transport mechanism) and sensing and quality-control equipment, while not shown or discussed, are acknowledged to make up the remainder of the present flexo folder gluer 1. It will also be appreciated that certain operations may be consolidated, as, for example, gluing station 400 and folding station 500 can form a single station. Other stations, such as printing station 200, may be accomplished in a series of sub-stations (not shown). A quantity of sheets 10, shown in the figure as a stack 30, are introduced from the feeding station 100 to the print station 200 to receive printed indicia thereon by well-known printing methods. Sheet 10, which is typically corrugated cardboard ranging from a single layer of approximately 3 millimeters (mm) thick up to a multi-layer of approximately 15 mm thick, can include a series of panels 12, 14, 16 and 18 that are defined by creases 22 (alternately referred to as score lines), along which the various panels can be folded to form container structures of a desired dimension. The sheet 10 is typically fed into the flexo folder gluer 1 such that either of edges 15 or 13 can define the leading (or feed) edge, depending on which direction the sheet 10 is fed (as indicated by arrow A) into the feeding station 100. Lateral edge 17 generally coincides with a remote end panel (shown in the present figure as fourth panel 12), while lateral edge 19 generally coincides with a tab 20 used in subsequent folding operations. The gluing station 400 deposits adhesive (glue) along at least a portion of the length of one of the surfaces adjacent the edges 17, 19. As will be shown in more detail below, the gluing station 400 can be configured to deposit "top down", as shown by lines of adhesive 24 in the figure, or "bottom up" such that adhesive 24 is disposed on the opposing face from that shown. In addition, the flexo folder gluer 1 can be configured to have one gluing station 400 (which would enable the deposition of adhesive 24 on either fourth panel 12 or tab 20), or to have two gluing stations spaced apart and facing each other such that double gluing can occur, as both fourth panel 12 or tab 20 can simultaneously receive adhesive 24. It will be appreciated by those skilled in the art that while the adhesive 24 is shown as continuous lines along the travel path of the sheet 10, it could also be made up of discontinuous dots or beads (not shown). Sheet 10 can also include die cuts 26 that can be formed in the sheet 10 either prior to insertion of the sheet 10 into the flexo folder gluer 1, or by die cut station 300 that is part of the flexo folder gluer 1. Creases 28 (similar to creases 22) can be placed across the sheet feed direction A for additional folding options.

Figure 3:
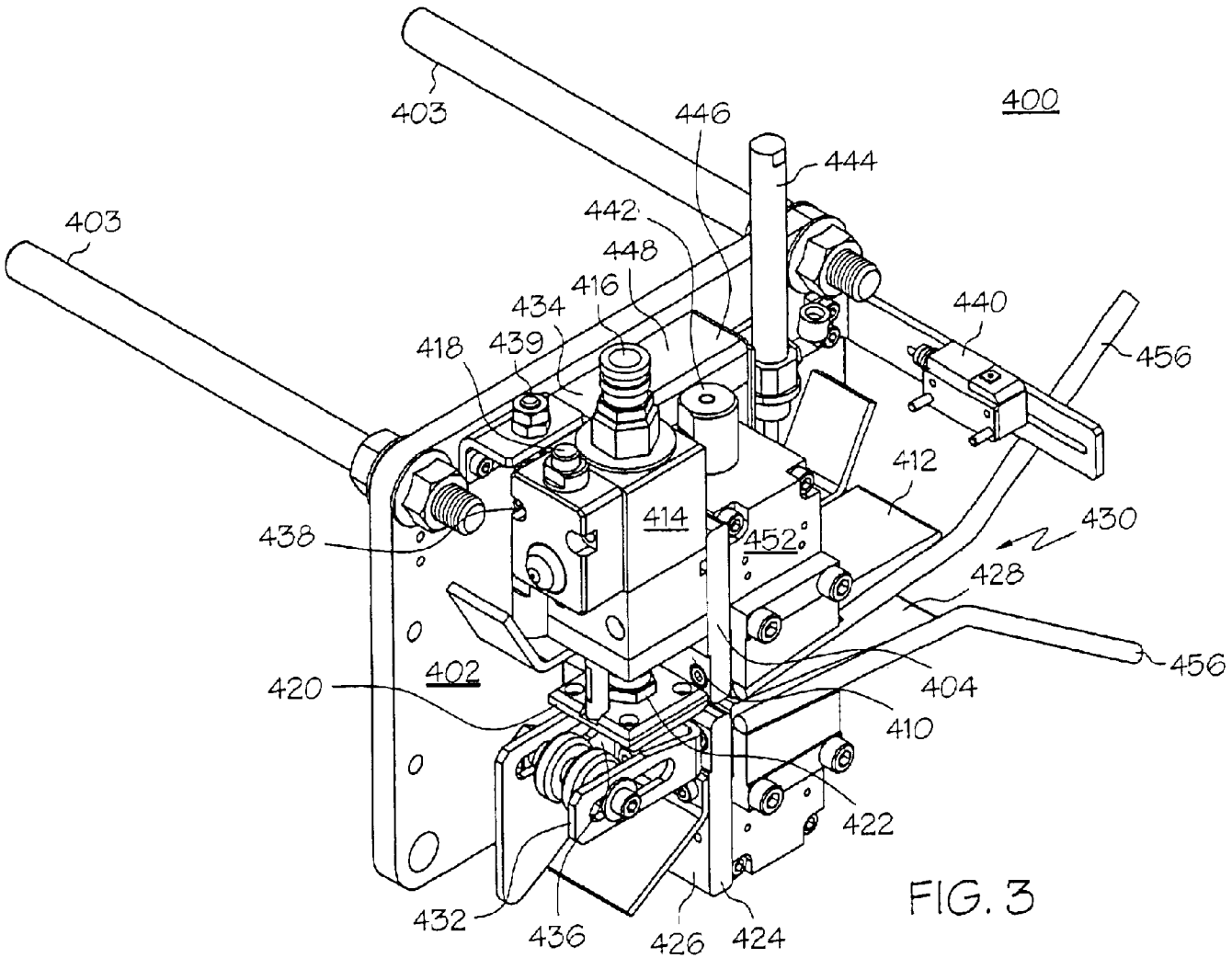
FIG. 3 shows a gluing station according to the present invention.

Referring next to FIG. 3, details of the gluing station (alternately referred to as a dispenser) 400 are shown. It will be appreciated by those skilled in the art that while the subsequent discussion is with regard to the dispenser operating on glue and related adhesives, the structure is not so limited, as such structure is equally applicable to the deposition of other liquids (for example, soap, lotion, release varnish or the like) onto a generally planar substrate. Base structure 402 is a plate onto which the remaining components can be secured, and may include additional structure (such as brackets and blocks) to ensure rigid connection to other parts. For example, sensor 440, used to detect the presence of a sheet (not shown) entering the gluing station 400, can be rigidly mounted to the base structure as shown. Base structure 402 itself can be attached to flexo folder gluer 1 through conventional attachments, such as rods 403. The base structure 402 has numerous holes of various spacings to facilitate attachment of various components. A first cartridge 404 is removably mounted to the base structure 402 through a variable coupling 434 which provides a slidable link between the base structure 402 and first cartridge 404. This slidable link allows coupling 434 and first cartridge 404 attached to it to move up and down vertically in response to passing sheets of differing thickness, or due to undulations in the sheet. First cartridge 404 includes a first mount 410 with a first inlet guide 412, a valve 414 and applicator head 420 fluidly connected via quick-release coupler 422. A second cartridge 424 is removably mounted to the base structure 402, and includes a second mount 426 with a second inlet guide 428 and outlet guide 432 (the latter alternately referred to as a bearing bar). When the cartridges 404, 424 are mounted onto the base structure 402, their placement relative to one another is such that one is situated vertically above the other so that a sheet travel path 430 is defined between them. As previously mentioned, the gluing station 400 can be configured as either "top down" (where the first cartridge 404 is above second cartridge 424) such that the glue is placed on an upward-facing surface on the sheet, or "bottom up" (where the second cartridge 424 is above first cartridge 404) such that the glue is placed on a downward-facing surface on the sheet. Accordingly, while the operation of the gluing station 400 is described in regard to the "top down" configuration as shown in the figure, it will be appreciated that the "bottom up" configuration is equally applicable.

The coupling 434, which includes a cartridge weight compensator 444 (discussed in more detail below), is connected to the uppermost of the two cartridges (shown presently as first cartridge 404) such that the uppermost cartridge moves along a linear path defined by a bearing 446 in the coupling 434. The slidable link is preferably a linear bearing 446 that is aligned with the vertical axis. To prevent the mechanism of the linear bearing 446 from becoming clogged with glue, a housing 448 is placed around the linear bearing 446. This is especially beneficial in "bottom up" glue deposition, as it can protect the linear bearing 446 against accidental valve actuation (which generally results from an accidental scanner trigger from jammed sheets or cut-off tabs from a die cutter), where a pressurized stream of glue would otherwise splash the linear bearing 446 and adjacent components. In addition, housing 448 serves as a guard against dust and related airborne contaminants. Products to be glued, such as sheets (not presently shown), pass into the sheet travel path 430 in sequential fashion, to be channeled by the inlet guides 412 and 428, which together define a convergent path along the sheet travel path 430 that narrows down to allow passage of the sheet between applicator head 420 and outlet guide 432. Additional sheet inlet guiding is promoted by the inclusion of optional expansion guides 456 that axially align with the convergent path formed by inlet guides 412 and 428 along the length of the inlet guides, but also capture a larger space in front of the inlet guides. Gluing station 400 is mounted so that the lower surface configured to contact the product is in the same horizontal plane as the as the product's lower surface. Thus, where "top down" gluing is desired, the vertically uppermost part of outlet guide 432 is configured to be in the same horizontal plane as the bottom of a passing sheet, while in the "bottom up" configuration, the engaging surface of the applicator head 420 would be in the same horizontal plane as the sheet's downward-facing surface. The expansion guides 456 provide additional means of guidance and support in situations where the sheets being fed are not closely aligned with sheet travel path 430. Such a case of misalignment may occur when a sheet with severe warpage is being fed into the gluing station 400. Glue enters into valve 414 from a glue source through inlet port 416, and passes through a quick-release coupler 422 and into applicator head 420. Actuator power (be it electric or a pressurized fluid) enters through port 418. Manually-depressible knobs 442 are spring-actuated to allow for quick-release of the cartridges 404, 424 from the variable coupling 434 and base structure 402, respectively.

Figure 6B:
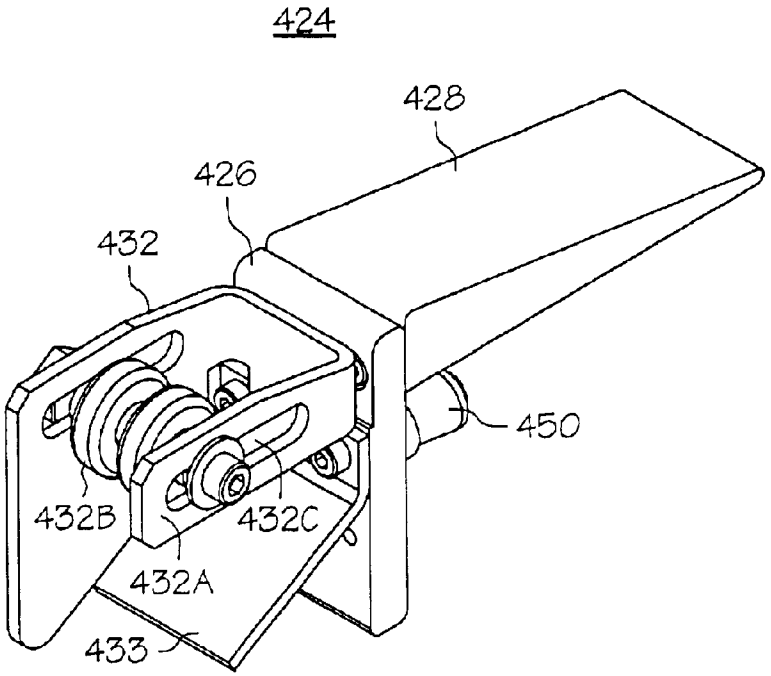
FIG. 6B shows the second removable cartridge of FIG. 6A in perspective view, with outlet guide attached.
Figure 6A:
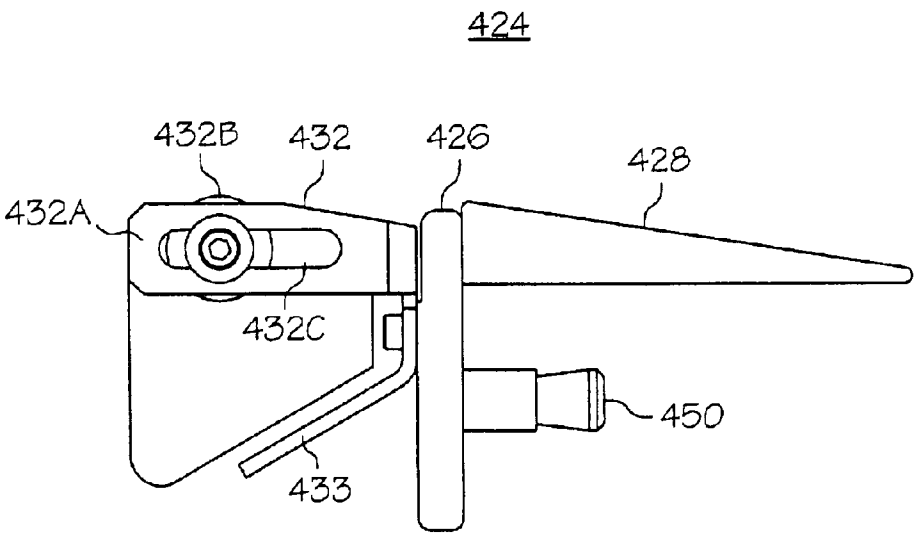
FIG. 6A shows a second removable cartridge in plan view, with outlet guide attached.
Figure 7B:
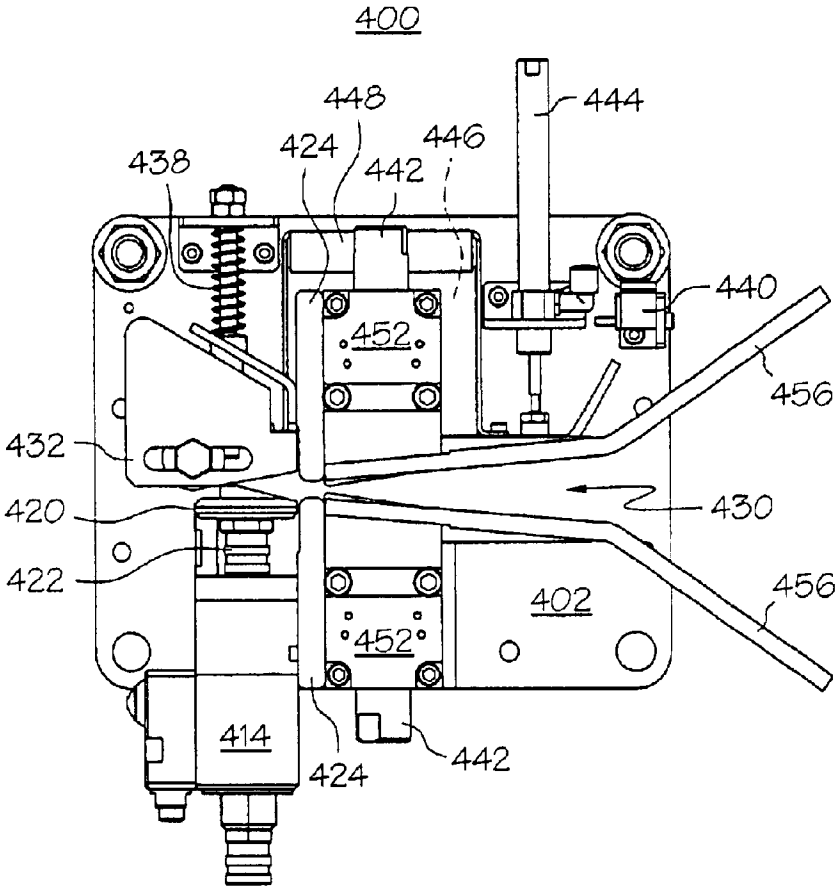
FIG. 7B shows the gluing station of FIG. 3 in its bottom-up configuration for depositing glue on an end panel of the corrugated sheet of FIG. 2.
Figure 7A:
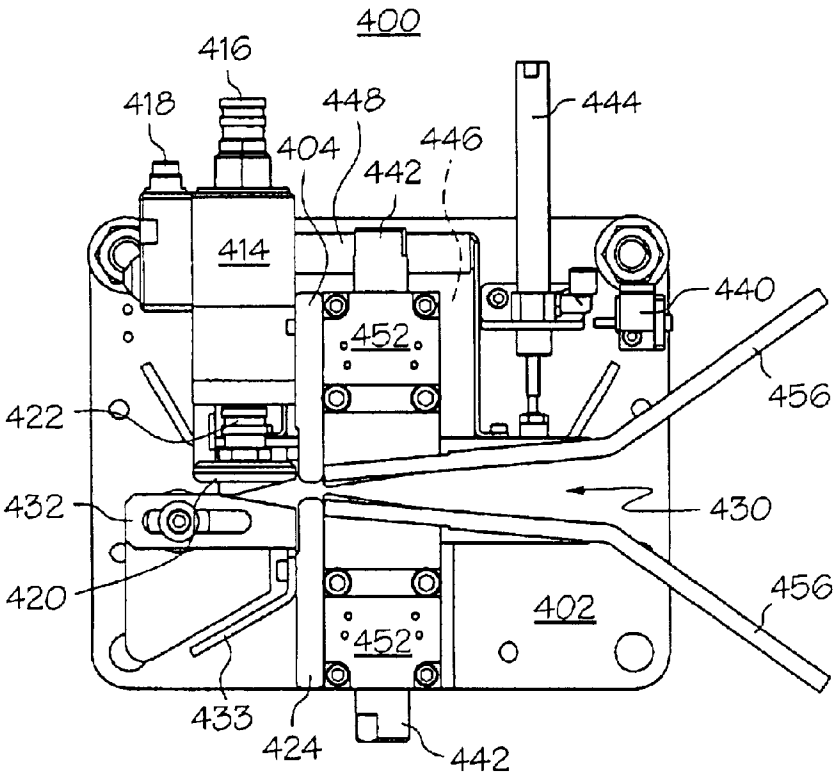
FIG. 7A shows the gluing station of FIG. 3 in its top-down configuration for depositing glue on an end panel of the corrugated sheet of FIG. 2.
Figure 8B:
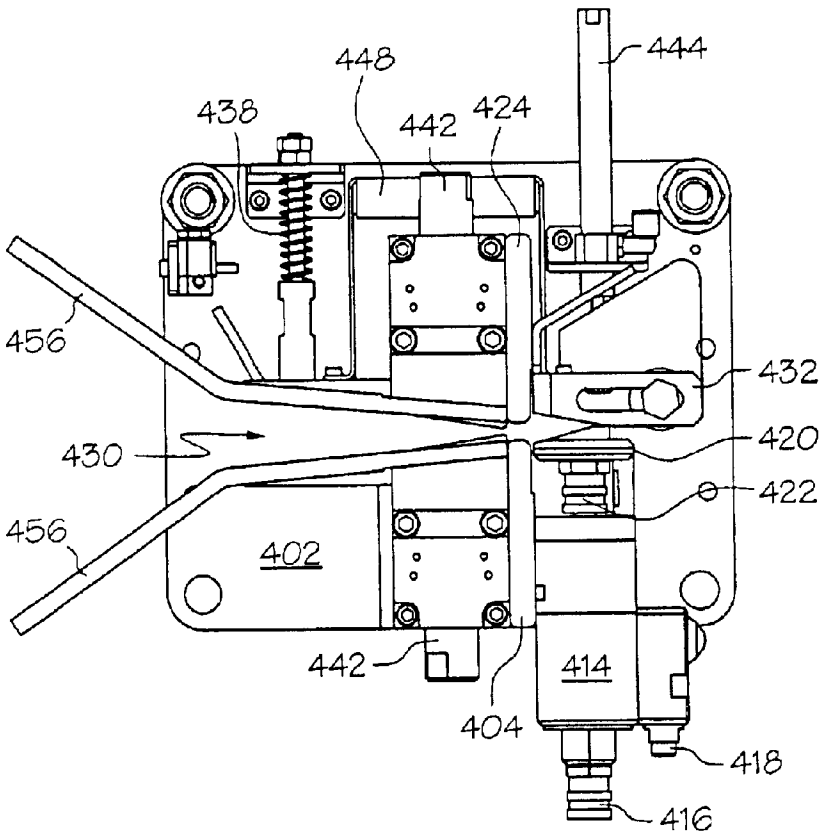
FIG. 8B shows the gluing station of FIG. 3 in its bottom-up configuration for depositing glue on a tab of the corrugated sheet of FIG. 2.
Figure 8A:
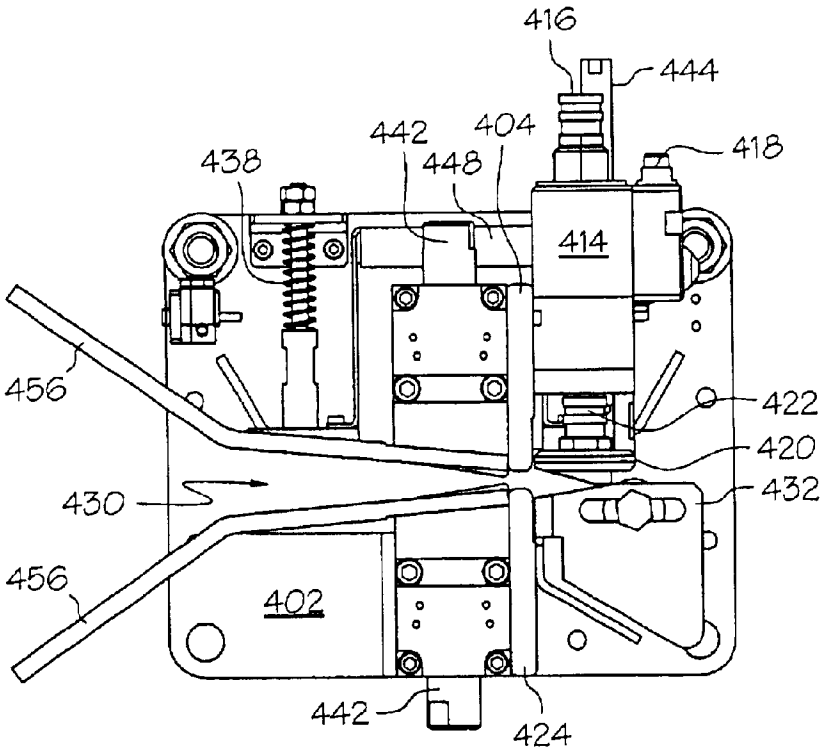
FIG. 8A shows the gluing station of FIG. 3 in its top-down configuration for depositing glue on a tab of the corrugated sheet of FIG. 2.

Referring next to FIGS. 6A and 6B in conjunction with FIG. 3, the placement of the applicator head 420 relative to the outlet guide 432 is relatively narrow along the vertical dimension such that even a thin sheet of corrugated paper passing between them will be in simultaneous contact with both. Outlet guide 432 is made up of a bracket with tangs 432A that extend parallel to sheet travel path 430. The tangs 432A define a substantially smooth path over which the sheet will travel, and can be augmented by a pair of rollers 432B mounted on a shaft connected to the tangs 432A. These rollers 432B can lower the frictional resistance that a passing sheet passing between them and applicator head 420 will experience, thus reducing the likelihood of sheet pinching and jamming. The position of the rollers 432B along the sheet travel path 430 can be adjusted by moving the rollers 432B along slotted rail 432C defined in tangs 432A. In operation, the sheet first encounters applicator head 420 which deposits one or more parallel rows of glue onto a surface of the sheet. The corrugated sheet is rigid enough that the sheet stays substantially flat between the small contact surface of applicator head 420 and outlet guide 432. The vertical dimension of a gap 436 formed between the applicator head 420 and outlet guide 432 can vary, depending on the thickness of the sheet. This is accomplished when the leading edge 15 of sheet 10 contacts the uppermost cartridge (in this case, the first cartridge 404), which in turn causes the coupling 434 to move the applicator head 420 out of the sheet's way, while simultaneously compressing spring 438. In addition, the width of gap 436 can be manually adjusted by varying a gap setting rod 439 disposed concentrically within spring 438. This allows the force on the passing sheet 10 to be adjusted by changing the compression on the spring 438. By being movably responsive to the passage of a thicker sheet, the coupling 434 reduces the likelihood of sheet pinching and jamming. Once the thick sheet has passed through gluing station 400, the spring 438 forces the coupling 434 and mounted first cartridge 404 with applicator head 420 to return to a neutral position (which can be predetermined through adjustment of a pair of hex nuts threaded onto gap setting rod 439 within spring 438) to await the arrival of the next sheet. To avoid having to overcome inertial effects due to the weight of the cartridge 404, a cartridge weight compensator 444 can be mounted between the base structure 402 and the coupling 434. The compensator 444 is in the form of a fluid-charged (preferably air) cylinder that can produce an upward force that offsets the downward force exerted by the weight of cartridge 404.

Figure 4B:
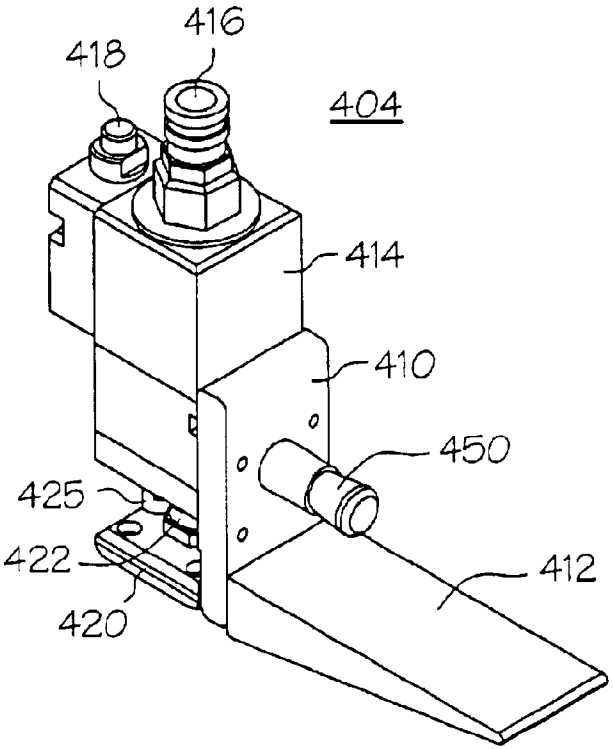
FIG. 4B shows the first removable cartridge of FIG. 4A, in perspective view.
Figure 4A:
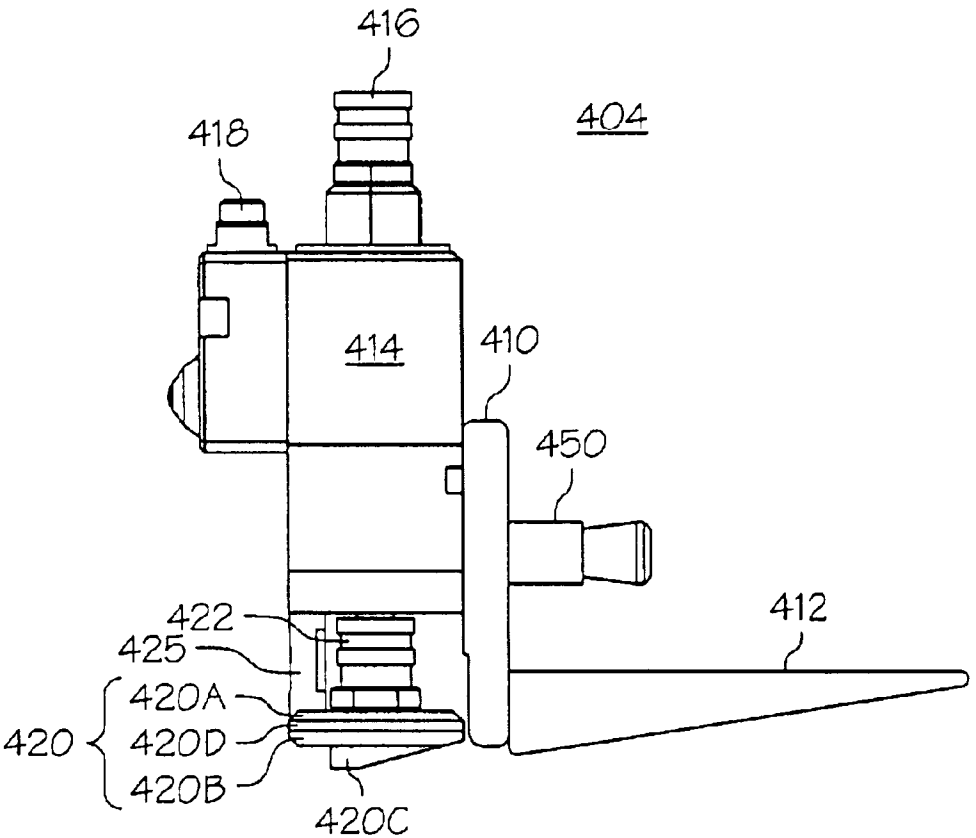
FIG. 4A shows a first removable cartridge in plan view, with valve and applicator head attached.

Referring next to FIGS. 4A and 4B in conjunction with FIGS. 6A and 6B, details about the structure of the cartridges 404, 424 and their mounting scheme are shown. First mount 410 provides the primary backbone of first cartridge 404. Valve 414 is affixed to first mount 410, as is first inlet guide 412 and connecting pin 450, the latter used to engage a spring-biased lock not shown). An aperture in mounting block 452 attached to base structure 402 accepts connecting pin 450, while the manually-depressible knobs 442, which are secured in mounting block 452, are spring-biased to hold connecting pin 450 in place. Since connecting pin 450 is the only part of cartridge 404 being held in place, manual unlocking and disconnecting of the cartridge 404 can be easily accomplished. The aforementioned glue and actuation ports 416, 418 on valve 414 are connected to their respective sources with flexible lines (not shown). There is enough extra length (or "play") in these lines to allow first cartridge 404 to be removed from the "top down" configuration shown, and placed in a "bottom up" configuration without having to disconnect the lines. Applicator head 420 is mounted directly to and fluidly coupled with valve 414 using a quick-release coupler 422. Proper orientation between the bottom of valve 414 and applicator head is ensured through a slot and pin alignment mechanism 425. Similarly, second mount 426 provides the primary backbone of second cartridge 424. As with the first mount 410, second mount 426 includes a connecting pin 450 to affect a mounting relationship between it and a mounting block 452 attached to the base structure 402. Since the connection dimensions of the two cartridges and their respective mounts are the same, they may be interchanged through the quick-release features of the connecting pin 450 and manually-depressible knobs 442. In addition to inlet guide 428 and connecting pin 450, second mount 426 also holds outlet guide 432, as well as a splash guard 433. The splash guard 433 functions to deflect excess glue away from components that would otherwise get clogged up.

Figure 5B:
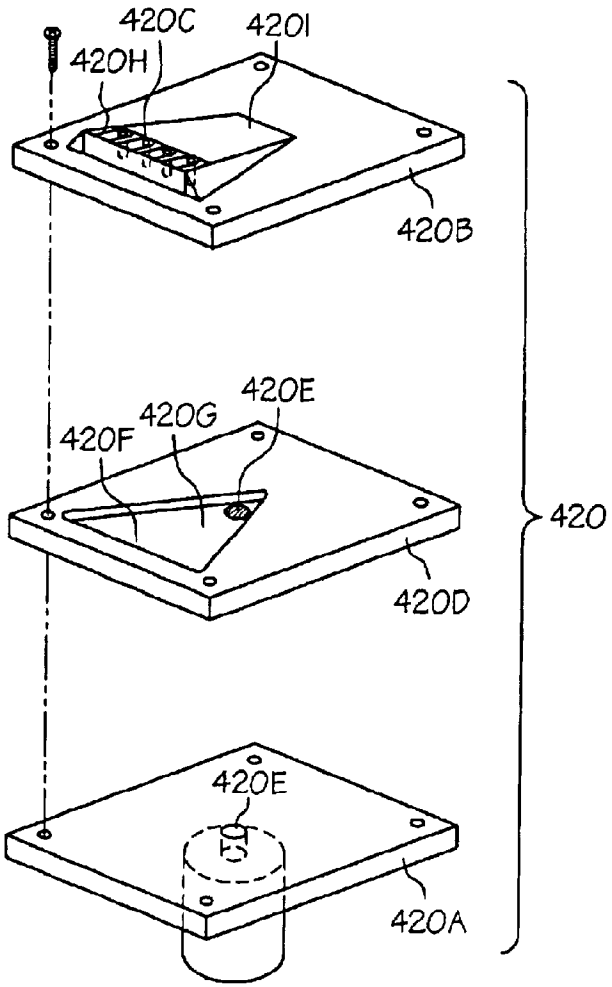
FIG. 5B shows an exploded view of the applicator head of FIG. 5A.
Figure 5A:
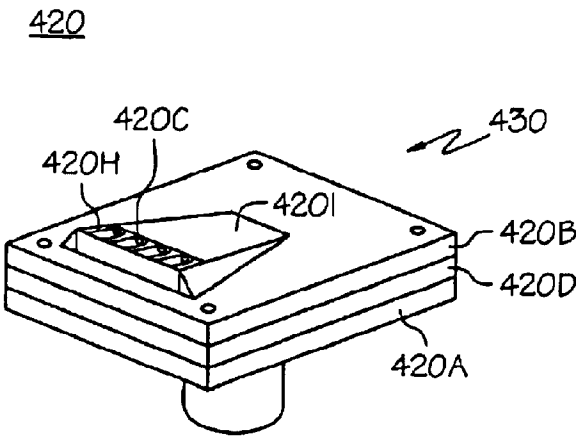
FIG. 5A shows the applicator head removed from the cartridge of FIGS. 5A and 6B.
Figure 5C:
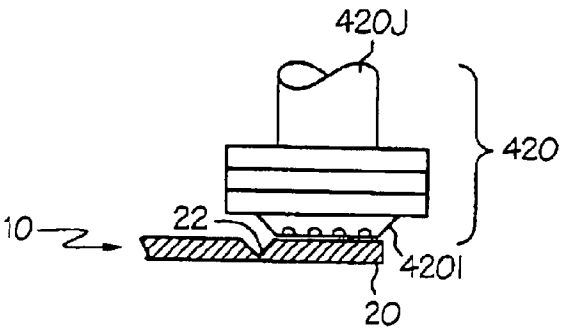
FIG. 5C shows an elevation view of the applicator head in a top-down, tab-side position engaging a protruding tab along the travel direction of the corrugated sheet.
Figure 5D:
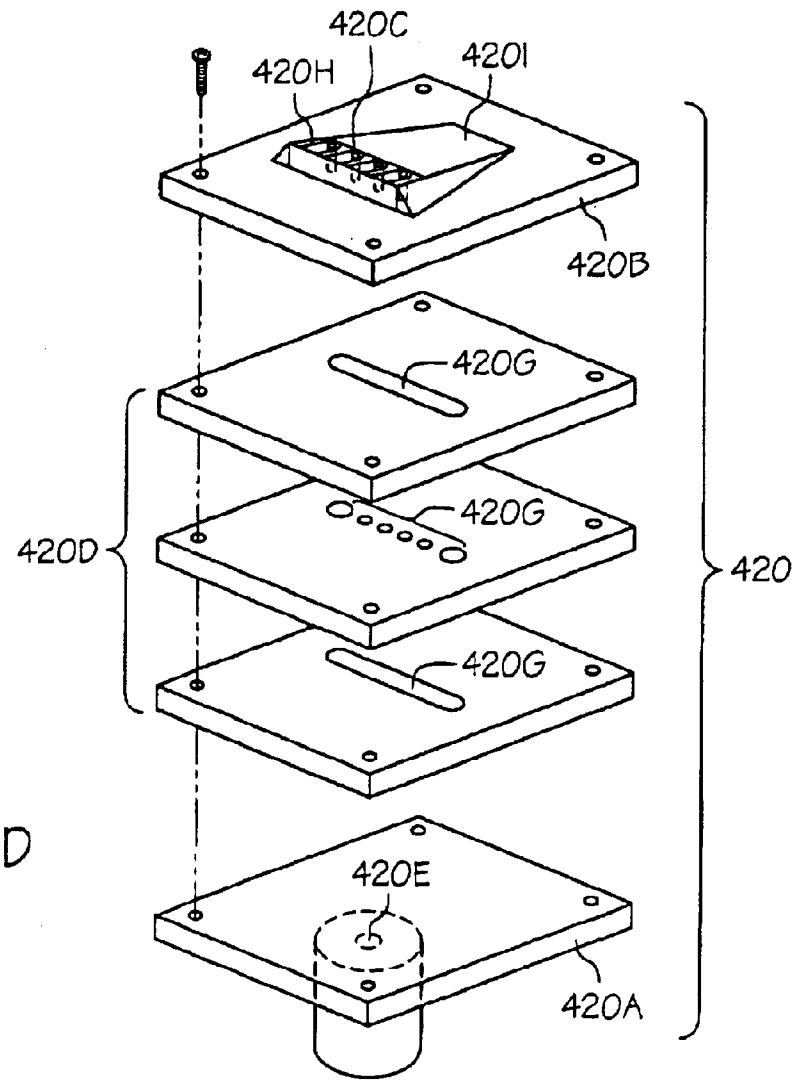
FIG. 5D shows an exploded view of an alternate applicator head with a multi-layer shim.

Referring next to FIGS. 5A through 5D, details of the applicator head 420 are shown. A sandwich-like construction is made up of a glue inlet 420A, glue outlet 420B disposed opposite the glue inlet 420A, and a shim 420D containing a manifold between the two. The glue outlet 420B terminates in an anvil 420I with a plurality of apertures 420C, while glue inlet 420A terminates with an adapter 420J that engages the quick-release coupler 422. The shim 420D is used to seal fluids between the anvil 420I and the glue inlet 420A. Flowpath 420G is machined into the shim 420D in a shape that will allow the glue to flow from the flow channel inlet 420E to the apertures 420C in such a way as to minimize air pocket formation, as well as to allow for a more even glue flow to all apertures. Such an arrangement also decreases latency upon the application and removal of glue pressure, as there is no tortuous path between glue inlet 420A and flowpath 420G, thereby minimizing the chance of glue buildup at bends or air pockets along the way. Once the glue enters the main chamber defining a glue flowpath 420G, the flowpath's gradually tapered (rather than abruptly changing) shape allows the glue to spread along concentric cylindrical wavefronts such that by the time the waves reach the distal end 420F of the flowpath, the flow to each of the linearly-arranged apertures 420C is substantially equal, thus minimizing the chance of starving the outermost apertures. It will be appreciated by those skilled in the art that other diverging shapes besides the linear taper of glue flowpath 420G shown in the figure could be utilized, so long as the flowpath avoids sharp turns and related tortuous paths that could lead to air pockets and an uneven distribution of glue in the plurality of apertures 420C. For example, glue flowpath 420G can take on a fluted or parabolic shape. Although shim 420D is shown as a single layer design in FIGS. 5A and 5B, it could also employ multiple shim layers, or plates, to increase the vertical dimension of the glue's flowpath, or to provide different flow channel configurations. For example, as shown in FIG. 5D. a multi-layer approach could be used where a plurality of internal apertures making up flowpath 420G could be arranged on one or more of the plates to ensure a generally even distribution of glue to all of the apertures 420C. Such a configuration allows the glue flow to be tailored to match differing glue viscosity and pressure. Varying the number of plates, or changing plate thickness can also be used to increase or decrease glue flow, as needed. In operation, glue passing through applicator head 420 passes through the apertures 420C on the faceted anvil 420I as the anvil contacts passing sheets. The anvil 420I gradually tapers inward along the direction of the sheet travel path 430 (shown with particularity in FIG. 5A) to coax the sheet away from any normal edges that might otherwise snag a sheet feed edge 13 or 15 (shown in FIG. 2). More pronounced lateral tapers lead up to the plurality of apertures 420C arranged at the anvil's plateau. Downstream of the plateau and the apertures 420C disposed therein, the anvil drops off with a pronounced taper to avoid buildup of excess glue along a sheet-engaging surface of the glue outlet 420B. The apertures 420C can be recessed slightly from the engaging surface of the plateau, and may further include recessed flow channels 420H that surround each aperture to promote parallel deposition of the glue to the sheet travel path. This also allows minimum spacing from the orifice to the sheet 10, thus reducing trailing glue patterns. Referring with particularity to FIG. 5C, the position of the applicator head 420 relative to a tab 20 of sheet 10 is shown. The faceted head on anvil 420I stays between the score line 22 and the edge of tab 20 to ensure flat contact between the apertures in the anvil and the tab 20.

Referring next to FIGS. 7A, 7B, 8A and 8B in conjunction with FIG. 2, elevation views of both "top down" (FIGS. 7A and 8A) and "bottom up" (FIGS. 7B and 8B) glue deposition are shown. The simultaneous use of two of the gluing stations 400, such as that of FIGS. 7A and 8A together, or FIGS. 7B and 8B together, can produce rows of glue on both the aforementioned fourth panel 12 and tab 20 in a single pass. Comparing FIG. 7A to FIG. 7B (and FIG. 8A to FIG. 8B), it can be seen that the first cartridge 404 is interchangeable with second cartridge 424, and that regardless of orientation, the continual cooperation between a passing sheet 10 along sheet travel path 430 and the upper cartridge (404 in FIGS. 7A and 8A, and 424 in FIGS. 7B and 8B) and spring 438 through coupling 434 and cartridge weight compensator 444 is ensured.

Figure 9B:
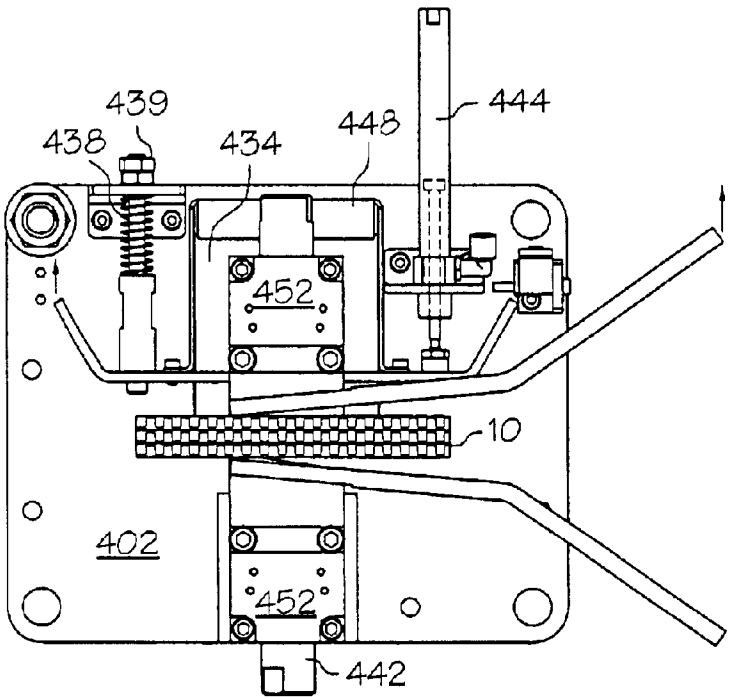
FIG. 9B shows the gluing station of FIG. 9A as a corrugated sheet passes therethrough.
Figure 9A:
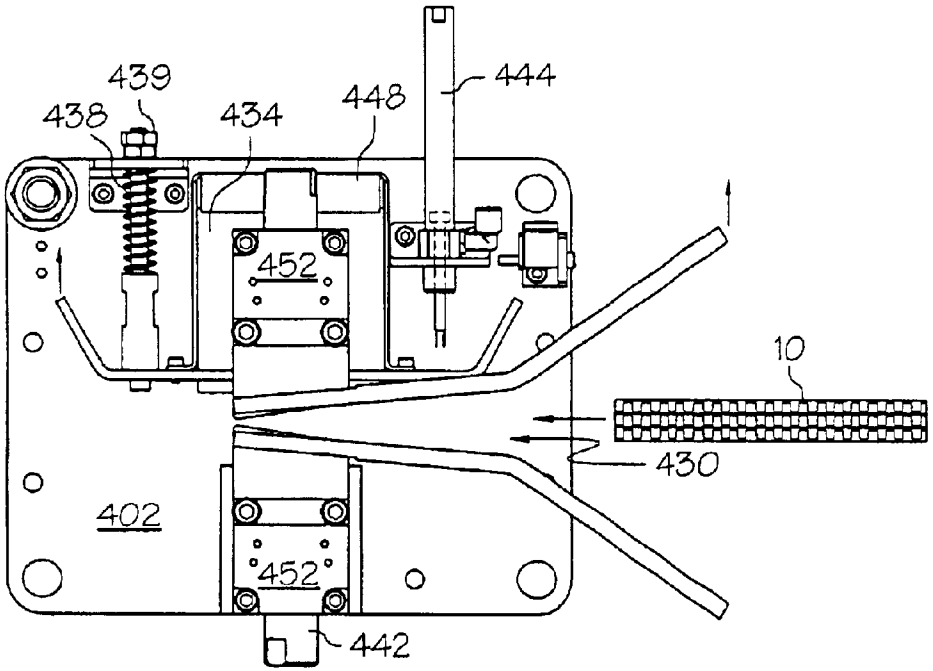
FIG. 9A shows the gluing station of FIG. 3, with the removable cartridges removed for clarity, prior to the introduction of a corrugated sheet.

Referring next to FIGS. 9A and 9B, a remote, or "fourth panel" setup of gluing station 400 is shown, with the cartridges removed to show more clearly the construction and vertical movement of the variable coupling 434 in response to the presence of a thick sheet 10 of corrugated cardboard at applicator head (not presently shown). While the bottom mounting block 452 remains stationary (being fixed to the base structure 402) the variable coupling 434 (which is coupled to cartridge weight compensator 444 and includes sled 454, spring 438, mounting block 452, gap setting rod 439 with hex nuts and slidable bearing 446 with housing 448), translates along the vertical direction (as shown in FIG. 9B) in an amount proportional to the thickness of sheet 10. The restoring force inherent in spring 438 is sufficient to return the variable coupling 434 to its neutral position once the sheet 10 has passed. Sled 454, which is attached to the top mounting block 452, acts as a mounting rail to which gap setting rod 439, bearing 446 and housing 448 and one of the cartridges (not presently shown) are attached. A plunger mounted to sled 454 also moves in and out of cartridge weight compensator 444 in response to sled movement, and its piston-like presence in the compensator produces a resistance therein that keeps the pressure on the passing sheet relatively constant. Cartridge weight compensator 444 is an air cylinder that acts as a counterweight. By applying air pressure to the cylinder, some or all of the weight of the cartridge is relieved or cancelled out, thereby making it easier for the passing sheet 10 to lift the sled 454. The spring 438 keeps pressure against the cartridge weight compensator 444, thus allowing the applicator head 420 to stay in contact with the sheet 10 and avoid bouncing. The combination of the spring 438 and cartridge weight compensator 444 results in the applicator head 420 behaving like a spring-mass-damper dashpot: as the sled 454 moves in a downward direction, this dampens the bouncing due to the spring 438, as the compressed air acts to decelerate the downward motion.

While certain representative embodiments and details have been shown for purposes of illustrating the invention, it will be apparent to those skilled in the art that various changes may be made without departing from the scope of the invention, which is defined in the appended claims.

What is claimed is:

1. An applicator head for an adhesive dispenser, said applicator head comprising:

an adhesive inlet;

an adhesive outlet in fluid communication with said inlet, said outlet defining a plurality of apertures arranged substantially linearly across a dispensing surface thereof; and a shim comprising:
a proximal end fluidly coupled to said inlet;
a distal end fluidly coupled to said outlet; and
an adhesive flowpath from said proximal end to said distal end, said flowpath divergently-shaped along a substantial portion thereof.

2. An applicator head according to claim 1, further comprising a quick-release mechanism disposed on said inlet.

3. An applicator head according to claim 1, wherein said dispensing surface further comprises a flow channel disposed about each of said plurality of apertures, each of said flow channels extending from said aperture to a trailing edge of said dispensing surface.

4. An applicator head according to claim 1, further comprising a plurality of bevelled surfaces adjacent to and tapering away from said dispensing surface.

5. An applicator head according to claim 4, wherein at least two of said plurality of bevelled surfaces are disposed along a lateral side of said applicator head.

6. An applicator head according to claim 1, wherein said shim is interchangeably disposed between said inlet and said outlet.

7. A liquid dispenser comprising:
a first cartridge comprising:
a first mount with a first inlet guide;
a valve coupled to said first mount, said valve configured to be coupled to a liquid source and an actuation source; and
an applicator head fluidly coupled to said valve, said applicator head comprising:
a liquid inlet configured to be coupled to a liquid source;
a liquid outlet in fluid communication with said liquid inlet, said liquid outlet defining a plurality of apertures therein; and
a shim comprising:
a proximal end fluidly coupled to said inlet;
a distal end fluidly coupled to said outlet; and
a flowpath from said proximal end to said distal end, said flowpath divergently-shaped along a substantial portion thereof; and
a second cartridge spaced relative to said first cartridge, said second cartridge comprising:
a second mount with a second inlet guide, said second inlet guide disposed relative to said first inlet guide such that a product travel path is defined therebetween; and
an outlet guide coupled to said second mount.

8. A liquid dispenser according to claim 7, wherein said product travel path converges along the direction of product travel such that said product is guided into contact with a dispensing surface defined on said liquid outlet.

9. A liquid dispenser according to claim 7, wherein said converging product travel path is made up of said first and second inlet guides configured as a pair of converging ramps.

10. A liquid dispenser according to claim 7, wherein said first and second cartridges are disposed vertically one above the other.

11. A liquid dispenser according to claim 10, wherein said cartridges are interchangeable with one another.

12. A liquid dispenser according to claim 7, wherein said applicator head is releasably coupled to said valve.

13. A liquid dispenser according to claim 12, wherein said applicator is configured to be quick releasable from said valve without the use of any tools.

14. A liquid dispenser according to claim 7, wherein said outlet guide comprises a bearing roller.

15. A liquid dispenser according to claim 14, wherein said bearing roller is slidably adjustable along said direction of product flow.

16. A liquid dispenser according to claim 7, wherein said valve is pneumatically-actuated.

17. A liquid dispenser according to claim 7, wherein said valve is electrically-actuated.

18. A liquid dispenser according to claim 7, further comprising a liquid deflector shield attached to said second mount.

19. A liquid dispenser comprising:
a base structure;
a first cartridge releasably coupled to said base structure, said first cartridge comprising:
a first mount;
a valve coupled to said first mount, said valve configured to be coupled to a liquid source and an actuation source; and
an applicator head fluidly coupled to said valve, said applicator head configured to deposit liquid onto a product while remaining in constant contact therewith;
a second cartridge releasably coupled to said base structure, said second cartridge spaced relative to said first cartridge, said second cartridge comprising:
a second mount; and
an outlet guide coupled to said second mount; and
a variable coupling linking at least one of said cartridges to said base structure, said coupling forcibly biased to define a first gap between said applicator head and said outlet guide, and movable in response to a force against at least one of said outlet guide and said applicator head to a second gap that is greater than said first gap.

20. A liquid dispenser according to claim 19, further comprising:
a first inlet guide coupled to said first mount; and
a second inlet guide coupled to said second mount, said second inlet guide disposed relative to said first inlet guide such that a product travel path is defined therebetween.

21. A liquid dispenser according to claim 19, wherein said second cartridge is spaced relative to said first cartridge such that one is substantially vertically spaced over the other.

22. A liquid dispenser according to claim 19, wherein said bias is affected by a spring mounted between said base structure and said coupling.

23. A liquid dispenser according to claim 19, wherein said applicator head comprises:
a liquid inlet configured to selectively receive liquid through said valve;
a liquid outlet in fluid communication with said liquid inlet, said liquid outlet defining a plurality of apertures therein; and
a shim comprising:
a proximal end fluidly coupled to said inlet;
a distal end fluidly coupled to said outlet; and
a flowpath from said proximal end to said distal end.

24. A liquid dispenser according to claim 23, wherein said flowpath is divergently-shaped along a substantial portion thereof.

25. A liquid dispenser according to claim 19, further comprising a scanning device coupled to said mounting structure.

26. A liquid dispenser according to claim 19, further comprising a quick release mechanism coupled to at least one of said cartridges.

27. A liquid dispenser according to claim 19, wherein said coupling is linked to a vertically uppermost one of said first and second cartridges.

28. A liquid dispenser according to claim 27, further comprising a cartridge weight compensator coupled to said coupling, said cartridge weight compensator configured to apply a force to said coupling in opposition to a downward force component due to the weight of said uppermost cartridge.

29. A liquid dispenser according to claim 28, wherein said cartridge weight compensator comprises a fluid-actuated piston.

30. A liquid dispenser according to claim 29, wherein said fluid-actuated piston is pneumatically-actuated.

31. A liquid dispenser according to claim 28, wherein said cartridge weight compensator is configured to apply a variable force to said coupling.

32. A liquid dispenser according to claim 28, further comprising a linear bearing configured to limit the motion of said coupling along a substantially vertical axis.

33. A liquid dispenser according to claim 32, wherein a direction of movement imparted on said coupling by said cartridge weight compensator is parallel to the direction of movement said linear bearing.

34. A liquid dispenser according to claim 33, further comprising a housing around said linear bearing, said housing configured to prevent said liquid from contacting said linear bearing.

35. A liquid dispenser according to claim 28, wherein said cartridge weight compensator is mounted to said base structure.

36. A liquid dispenser according to claim 19, wherein each of said first and second mounts further comprise a connecting pin, said connecting pin configured to permit quick release from said base structure.

37. A glue dispenser comprising:

a base structure;

a first cartridge releasably coupled to said base structure, said first cartridge comprising:

a first mount with a first inlet guide;

a valve coupled to said first mount, said valve configured to be coupled to a glue source and an actuation source; and an applicator head fluidly coupled to said valve, said applicator head configured to deposit glue onto a product while remaining in constant contact therewith;

a second cartridge releasably coupled to said base structure, said second cartridge spaced relative to said first cartridge, said second cartridge comprising:

a second mount with a second inlet guide, said second inlet guide disposed relative to said first inlet guide such that a product travel path is defined therebetween; and an outlet guide coupled to said second mount; and a variable coupling linked between said base structure and at least one of said cartridges, said variable coupling movably responsive to the passage of said product through said product travel path such that variations in the thickness of said product cause said variable coupling and said at least one cartridge linked thereto to move a proportionate distance while at least one of said outlet guide and said applicator head remain in contact with said product.

38. A flexo folder gluer comprising:

a printing station;

a die cutting station;

a gluing station configured to deposit adhesive on at least one side of a corrugated sheet, said gluing station comprising:

a base structure;

a first cartridge releasably coupled to said base structure, said first cartridge comprising:

a first mount;

a valve coupled to said first mount, said valve configured to be coupled to a glue source and an actuation source; and an applicator head fluidly coupled to said valve, said applicator head configured to deposit glue onto a product while remaining in constant contact therewith;

a second cartridge releasably coupled to said base structure, said second cartridge spaced relative to said first cartridge, said second cartridge comprising:

a second mount; and an outlet guide coupled to said second mount; and a variable coupling linking at least one of said cartridges to said base structure, said coupling forcibly biased to define a first gap between said applicator head and said outlet guide, and movable in response to a force against at least one of said outlet guide and said applicator head to a second gap that is greater than said first gap;

a folding station; and a conveying mechanism configured to transport said corrugated sheet between said printing, die cutting, gluing and folding stations.

39. A flexo folder gluer according to claim 38, wherein said applicator head comprises:

a glue inlet configured to selectively receive glue through said valve;

a glue outlet in fluid communication with said glue inlet, said glue outlet defining a plurality of apertures therein; and a shim fluidly disposed between said glue inlet and said glue outlet, said shim comprising:

a proximal end adjacent said inlet;

a distal end adjacent said outlet; and a flowpath from said proximal end to said distal end.

40. A method of depositing liquid on a sheet of material, said method comprising:

configuring a liquid dispenser to comprise:

a base structure;

a first cartridge releasably coupled to said base structure, said first cartridge comprising:

a first mount;

a valve coupled to said first mount, said valve configured to be coupled to a liquid source and an actuation source; and an applicator head fluidly coupled to said valve;

a second cartridge releasably coupled to said base structure, said second cartridge spaced relative to said first cartridge, said second cartridge comprising:

a second mount; and an outlet guide coupled to said second mount; and a variable coupling linking at least one of said cartridges to said base structure, said coupling forcibly biased to define a first gap between said applicator head and said outlet guide, and movable in response to a force against at least one of said outlet guide and said applicator head to a second gap that is greater than said first gap;

inserting said sheet of material into said travel path;

establishing contact between said applicator head and said sheet of material; and depositing liquid on at least a portion of said sheet of material while said applicator head remains in contact with said sheet of material.

41. A method according to claim 40, comprising the additional step of configuring said applicator head to comprise:

a liquid inlet configured to selectively receive liquid through said valve;

a liquid outlet in fluid communication with said liquid inlet, said liquid outlet defining a plurality of apertures therein; and a shim fluidly disposed between said inlet and said outlet, said shim comprising:

a proximal end adjacent said inlet;

a distal end adjacent said outlet; and a flowpath from said proximal end to said distal end.

42. A method according to claim 40, wherein said sheet of material is a sheet of corrugated cardboard.

43. A method according to claim 40, wherein said first cartridge is configured to further comprise a first inlet guide coupled to said first mount, and said second cartridge is configured to further comprise a second inlet guide coupled to said second mount, said second inlet guide disposed relative to said first inlet guide such that a travel path for said sheet of material is defined therebetween.

* * * * *